US005482103A

United States Patent [19]

Burgess et al.

[11] Patent Number: 5,482,103

[45] Date of Patent: Jan. 9, 1996

[54] DOOR APPARATUS WITH RELEASE ASSEMBLY

[75] Inventors: Coy H. Burgess; Joel M. Bonnell, both of Dixon, Ill.

[73] Assignee: Raynor Garage Doors, Dixon, Ill.

[21] Appl. No.: 191,419

[22] Filed: Feb. 3, 1994

[51] Int. Cl.[6] ..... F05F 15/20

[52] U.S. Cl. ..... 160/9; 160/7; 160/190

[58] Field of Search ..... 160/9, 7, 1, 190, 160/193

[56] References Cited

U.S. PATENT DOCUMENTS

| | | | |
|---|---|---|---|
| D. 333,776 | 3/1993 | Cloutier | D8/358 |
| 3,637,004 | 1/1972 | Wardlow et al. | 160/133 |
| 3,640,332 | 2/1972 | Luby et al. | 160/133 |
| 3,981,343 | 9/1976 | DeVito | 160/9 |
| 4,088,201 | 5/1978 | MacFarlane | 182/5 |
| 4,147,197 | 4/1979 | Bailey et al. | 160/7 |
| 4,664,170 | 5/1987 | Labelle | 160/133 |
| 4,872,369 | 10/1989 | Critton et al. | 74/574 |
| 4,882,806 | 11/1989 | Davis | 16/198 |
| 4,953,778 | 9/1990 | Critton et al. | 228/173.6 |
| 4,981,165 | 1/1991 | Miller et al. | 160/191 |
| 5,103,890 | 4/1992 | Cloutier | 106/190 |
| 5,203,392 | 4/1993 | Shea | 160/7 |
| 5,259,433 | 11/1993 | Cloutier | 160/190 |

OTHER PUBLICATIONS

Raynor Rolling Doors & Electric Operators. Sketch.

"The Hermco 2000," Hermco Counterweight Systems.

*Primary Examiner*—Leslie A. Braun
*Assistant Examiner*—Anita M. King
*Attorney, Agent, or Firm*—Tilton, Fallon, Lungmus & Chestnut

[57] ABSTRACT

A closure apparatus for closing an opening in a partition with a frame disposed around the opening includes a drum member rotatably mounted to the partition at the top end of the opening. It also includes a curtain member secured to the drum member. The curtain member winds around the drum member to move out of the opening in the partition; and it extends from the drum member to close the opening. A counterweight connected to the drum member offsets the weight of the curtain member; and a reducing weight reduces the weight of the counterweight to allow the curtain member to drop from a raised position. An activating assembly engages the reducing weight with the counterweight and allows the curtain member to unwind from the drum member and close the opening.

17 Claims, 7 Drawing Sheets

70
66
45
68
62
67
63
63a
P2
48
61
59
60
58
52
54
57
56
51
64
46
46a
46b
50
44
53
49

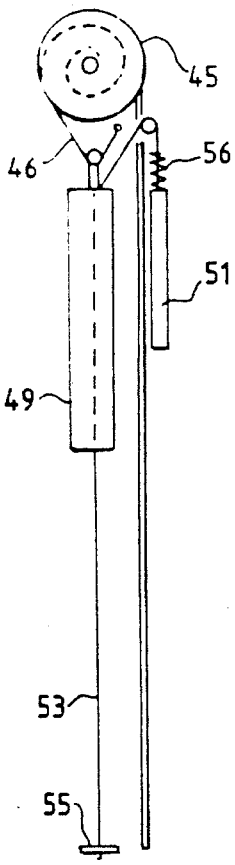
Fig. 8
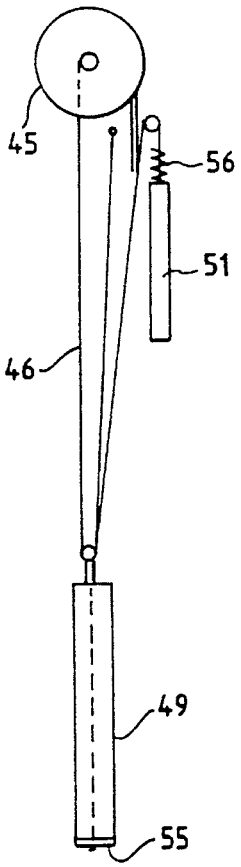
Fig. 9
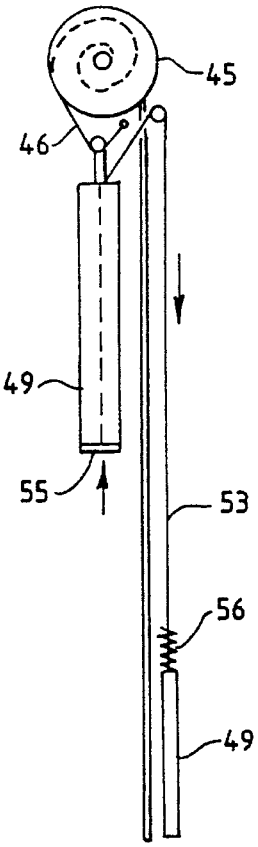
Fig. 10
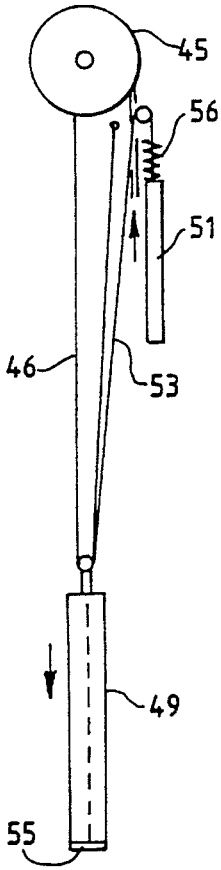
Fig. 11
Fig. 12
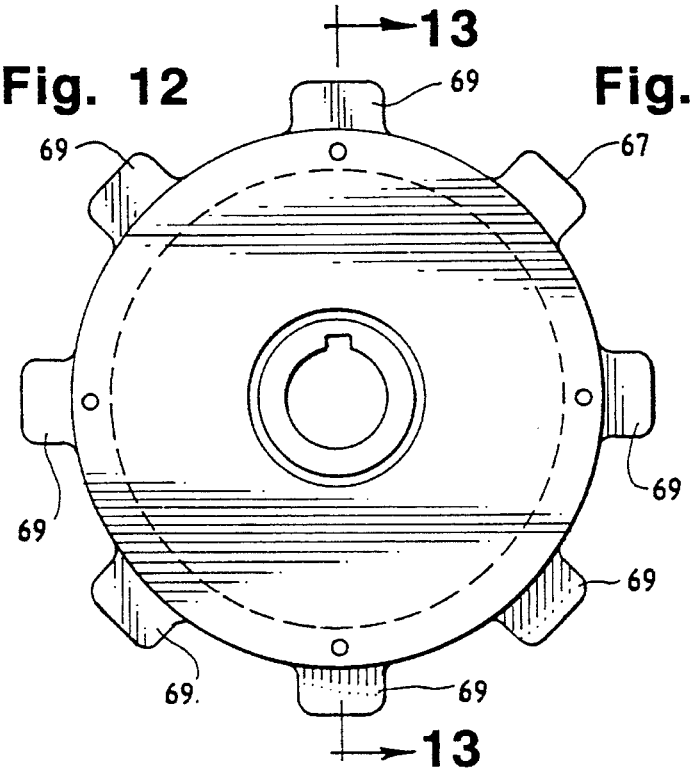
Fig. 13
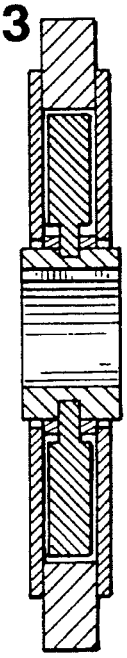

DOOR APPARATUS WITH RELEASE ASSEMBLY

BACKGROUND OF THE INVENTION

1. Field Of The Invention

The present invention relates to a door apparatus with a release assembly, and more particularly to a fire-rated, rolling steel door with a release assembly which allows an operator to easily and quickly drop test the door to determine if it will operate properly during a fire.

2. Description Of The Prior Art

A fire-rated, rolling steel door assembly typically includes a rolling steel curtain member, a drum for supporting the curtain, a counterbalance system for overcoming the weight of the curtain, and a drop or release assembly that allows an operator to drop the curtain from a raised position to determine if the curtain member will drop properly during a fire. The release assembly should allow quick and easy operation to encourage period "drop-testing" of the assembly.

Many prior fire-rated, rolling steel door assemblies utilize a torsion spring counterbalance mechanism (much like the mechanism used in standard non-rated fire doors) to overcome the weight of the door and thus allow an operator to open and close it. To drop-test these doors, one merely releases part of the turns or the winds in the torsion spring, allowing the door to drop. A system of oscillating governors, fluid clutch mechanisms, or centrifugal clutches control the descent of the door. These systems vary in size, construction and complexity depending on the door size.

The prior door assemblies described above suffer a number of disadvantages. They require skilled operators and special tools to drop test and reset them. To reset these prior assemblies, an operator usually must use a ladder, scaffold, or hoist and expose himself or herself to the danger of falling. Finally, in relatively large door assemblies, the components of the drop mechanism (e.g., oscillating governors) must withstand a great deal of stress and large impact forces. Thus, the manufacturers must use large amounts of costly material to construct them and thus avoid component failure.

The assembly of the present invention avoids the disadvantages of the prior art devices. It includes a counterbalance system that accurately balances the door throughout its descent. This system allows the use of components of reduced size to control the door during its descent; and it greatly minimizes the stresses and impact forces attributable to the drop mechanisms of the prior door assemblies. Moreover, the assembly of this invention allows the use of a standard size governor for all door sizes. It is a simple system which avoids complex procedures and provides smooth operation and reliable performance.

SUMMARY OF THE INVENTION

In accordance with one embodiment of the present invention, a closure apparatus for closing an opening in a partition with a frame disposed around the opening includes a drum member rotatably mounted to the partition at a top end of the opening. It also includes a curtain member (e.g., a rolling steel door) secured to the drum member. The curtain member winds around the drum member to move out of the opening in the partition; and it extends from the drum member to close the opening. A counterweight offsets the weight of the curtain member; and a reducing weight reduces the weight of the counterweight to allow the curtain member to begin its descent from a raised position. Activating means engage the reducing weight with the counterweight and allow the curtain member to unwind from the drum member and close the opening.

The apparatus further includes means for winding the curtain member back onto the drum member and governor means for controlling the descent of the door. A drive means connected to the drum member drives the drum member to wind the curtain member around the drum member. The drum member includes an axle and governor means which cooperates with the axle and a pawl member connected to the frame. This pawl member cooperates with the activating means as well as the governor means to reduce the speed of rotation of the axle as the axle rotates to allow the curtain member to unwind off of the drum member.

BRIEF DESCRIPTION OF THE DRAWINGS

For a more complete understanding of this invention one should now refer to the embodiment illustrated in greater detail in the accompanying drawings and described below by way of an example of the invention. In the drawings:

FIGS. 8–11 are schematic views of a counterweight and reducing weight arrangement with FIG. 8 showing the position of the weight elements when the curtain lies fully extended, FIG. 9 showing the position of the elements when the curtain lies fully raised and wound around a supporting drum, FIG. 10 showing the position of the elements after the curtain has descended, and FIG. 11 showing the position of the elements after the curtain has reached its raised position after a descent;

FIG. 12 is a front elevation view of the fluid governor shown in FIGS. 2 and 5 and used to control the descent of the curtain; FIG. 13 is a sectional view taken along line 13—13 in FIG. 12;

FIGS. **16*a*–16*e*** are schematic views of the spiral used in a drum used in a counterbalance of the present invention.

While the following disclosure describes the invention in connection with one embodiment and various modifications one should understand that the invention is not limited to this embodiment. Furthermore, one should understand that the drawings are not to scale and that graphic symbols, diagrammatic representations, and fragmentary views, in part, illustrate the embodiment. In certain instances, the disclosure may not include details which are not necessary for an understanding of the present invention, such as conventional details of fabrication and assembly.

DETAILED DESCRIPTION OF THE DRAWINGS AND AN EMBODIMENT

Figure 1:
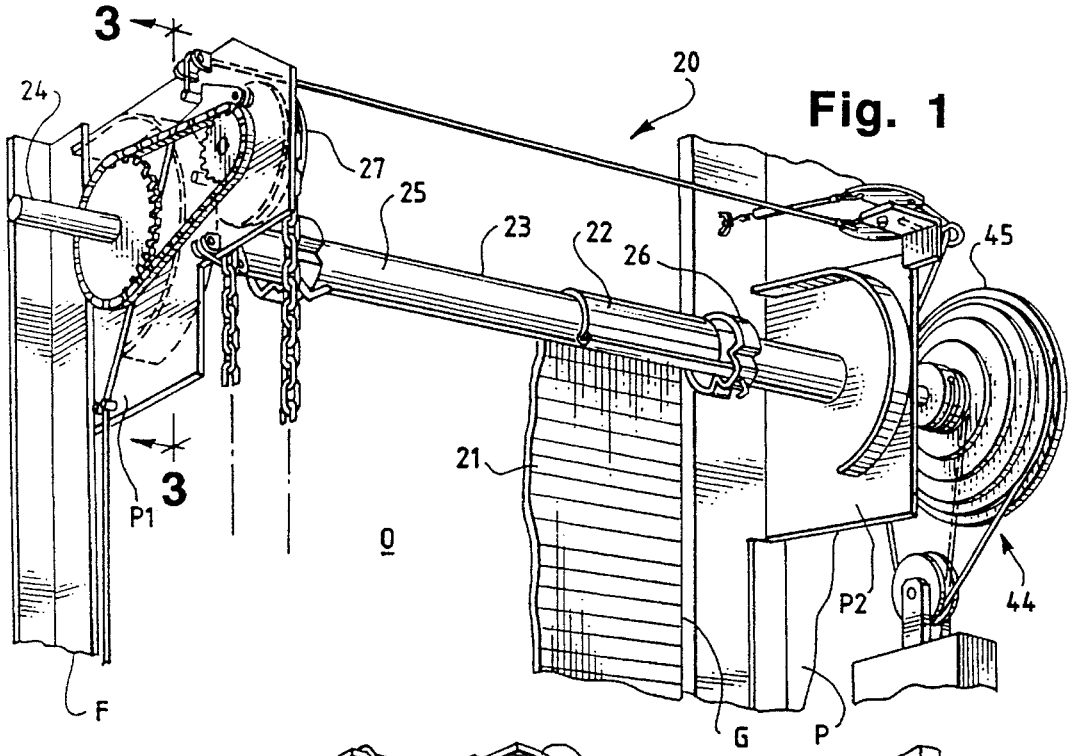
FIG. 1 is a perspective view of the closure apparatus of the present invention.
Figure 2:
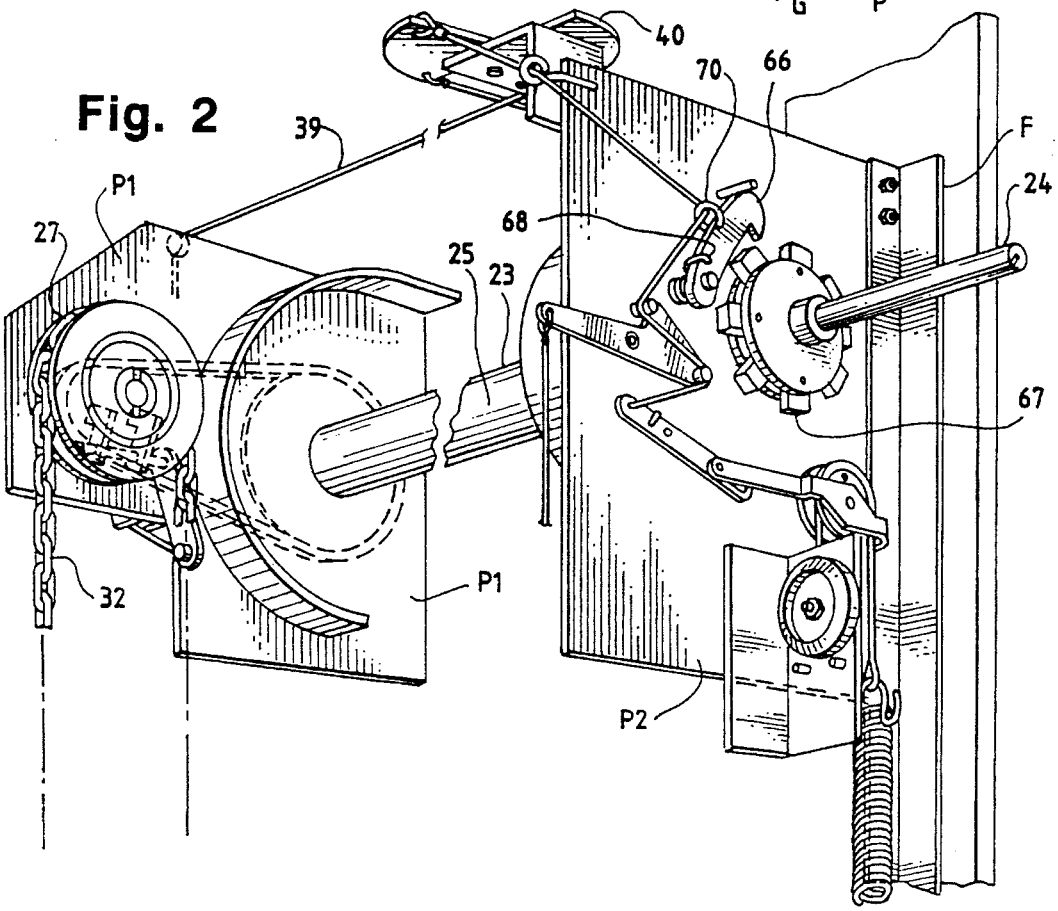
FIG. 2 is an enlarged partial perspective view of the closure apparatus showing an activating assembly used to drop-test a curtain member of the closure apparatus.

Turning now to the drawings and referring first to FIGS. 1 and 2, a door or closure apparatus 20 lies mounted to a vertical partition P and closes an opening O in the partition. The partition P includes a frame F which lies adjacent the opening. This frame F includes support plates P1 and P2 disposed at the top end of the opening and vertical guides G disposed along opposite sides of the opening. The support plates P1 and P2 support the closure apparatus 20; and the vertical guides G guide it, as described below.

The closure apparatus 20 includes an articulated steel rolling door or curtain 21 for closing the opening O. This curtain 21 comprises a plurality of interconnected horizontal slats which pivot relative to each other about horizontal axes. Edge portions of the curtain 21 extend between pairs of the vertical guides G in sliding relation with the guides. One end 22 of the curtain 21 lies secured to a drum member 23; the other, opposite end (not shown) defines the leading end of the curtain 21.

The drum member 23 lies adjacent the top of the opening O, rotatably mounted to the support plates P1 and P2. It includes an axle 24 which extends between the plates P1 and P2 and through suitably sized openings in the plates. The end portions of the axle extend outwardly of the plates to support the various components described below. The drum member 23 also includes a tube 25 which serves as a core around which the curtain 21 winds. The tube 25 lies around the axle 24 between the plates P1 and P2. Suitable connecting means secure the tube 25 to the axle 24 so that the tube 25 rotates with the axle; and ring-like clamps 26 secure the end 22 of the curtain 21 to the tube 25.

A chain hoist assembly 27 allows an operator to raise and lower the curtain 21. The support plate P1 supports this assembly which includes a chain hoist wheel 28 mounted to an axle 29 which lies rotatably mounted to the plate P1 (See FIGS. 3 and 4). The axle 29 extends through a suitably sized opening in the plate P1 and, in addition to the wheel, supports a drive sprocket 30 and a pin 31. The sprocket 30 lies fixedly secured at one end of the axle 29; and the pin 31 lies fixedly secured at the opposite end in perpendicular relation to the axle 29.

Using a chain 32, which extends around the wheel 28, an operator may rotate the wheel 28 and thus drive the sprocket 30 which then drives a larger, driven sprocket 33 (larger than the sprocket 30). This sprocket 33 lies fixedly secured to an end portion of the axle 24; and a continuous chain 34 connects it to the sprocket 30. The sprockets 30 and 33 and the continuous chain 34 form a reduction drive which facilitates the winding of the curtain 21 around the drum member 23.

Figure 4:
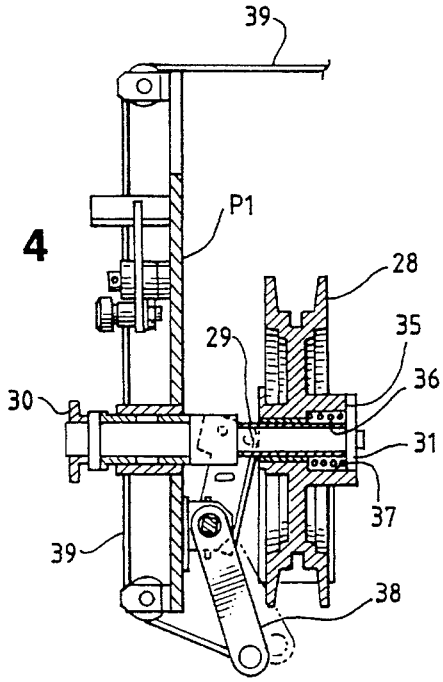
FIG. 4 is a sectional view taken along line 4—4 in FIG. 3.

The chain hoist wheel 28 drives the axle 29 only when it lies in the position shown in FIG. 4. In this position, the wheel 28 lies in its outermost position relative to the plate P1, pressed against the pin 31 which lies in a corresponding groove 35 in the wheel 28. The pin 31 locks the wheel 28 to the axle 29 so that they may both rotate together. A compression spring 36 (shown compressed in FIG. 4) lies in an opening 37 in the wheel 28. This spring 36 biases the wheel 28 away from the pin 31 towards the plate P1 to a position (not shown) in which the pin 31 lies out of the groove 35.

A lever 38 pivotally mounted to the plate P1 lies between the plate P1 and the chain hoist wheel 28. It pivots between the position shown in phantom lines in FIG. 4 and the position shown in solid lines in the same figure to slide the wheel 28 into engagement with the pin 31. An operator may move the lever 38 in this manner by removing a predetermined amount of slack from a cable 39 connected between one end of the lever 38 and a pivoting link 40. The cable 39 extends between these two components via an arrangement of guides and rollers shown in FIGS. 1, 3 and 4.

The operator may remove the slack from the cable 39 from below by moving a pivoting arm 41 (with a cable or chain 1*a*) to the position shown in FIG. 3. The arm 41 engages the cable 39 with a knob 42 and removes the slack as it moves towards a stop 43 which stops it. The link 40 also controls the slack in the cable 39. When the link 40 lies in the position shown in FIG. 7, only the pivot arm 41 may provide slack in the cable and then remove it.

Figure 3:
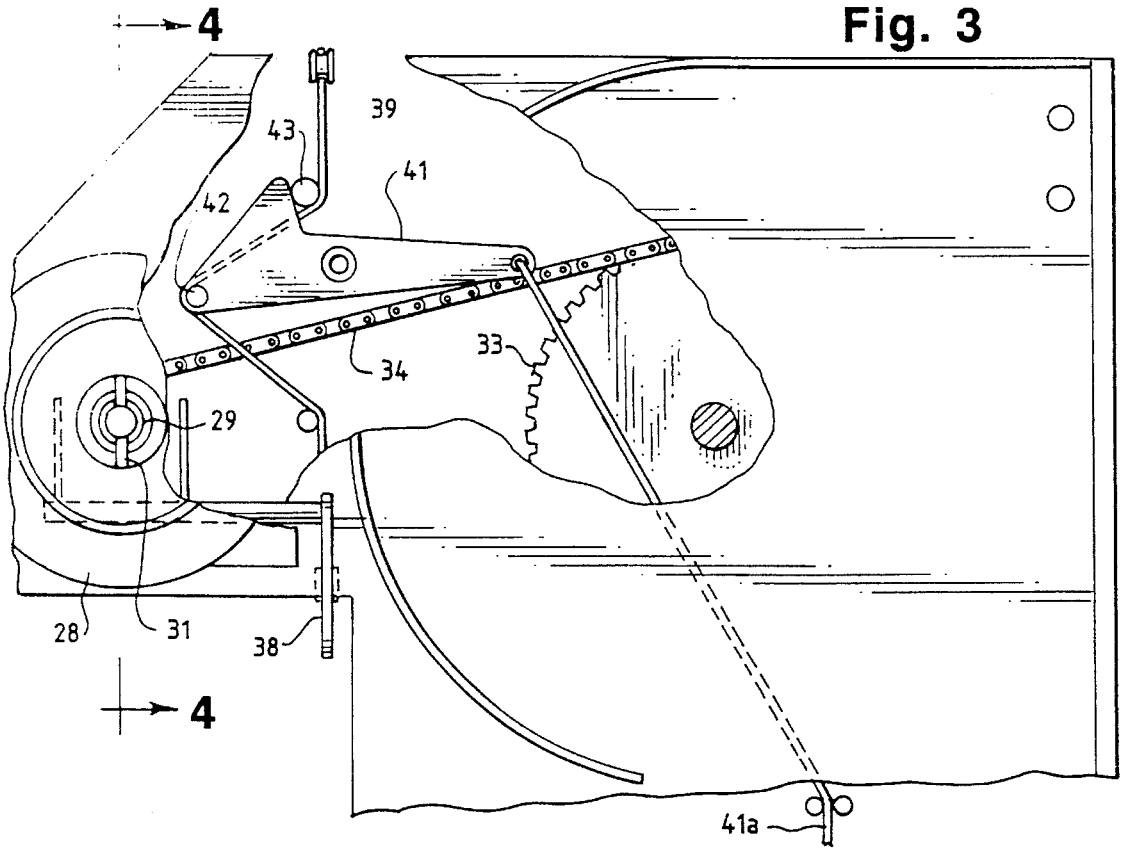
FIG. 3 is a side elevation view of the side of the closure apparatus showing the drive assembly used to raise and lower the curtain of the door assembly.

The arm 41 may allow the re-introduction of the slack into the cable 39 and allow the spring 36 to disengage the wheel 28 by pivoting counterclockwise (in FIG. 3). Also, the link 40 may provide slack in the cable 39 by moving counterclockwise (in FIG. 7). To allow counterclockwise movement of the arm 41 the operator merely releases the cable 41a. The text below describes the movement of the link 40.

Referring now to FIGS. 2 and 5–7, a counterbalancing assembly 44 offsets the weight of the curtain 21 to allow easy movement of the curtain between raised and lowered positions. This assembly 44 includes a drum 45 secured to the curtain axle 24 for rotation with the axle. The drum 45 defines a pair of spiral grooves 45*a* and 45*b* which extend along the outer surface of the drum with a continuously varying radius of curvature that approaches zero as the grooves approach the axis of the drum. The grooves receive two cable portions 46*a* and 46*b* of a cable 46.

The cable portions 46*a* and 46*b* wrap around the drum in the spiral grooves in response to rotation of the drum 45 in one direction; and they unwrap from the drum in response to rotation in the opposite direction. Suitable securing means secure the ends of the cable portions 46*a* and 46*b* to the drum as at 47. The opposite ends of the portions 46*a* and 46*b* define a continuous loop which extends around a pulley 48 rotatably mounted to the support plate P2 (See FIG. 6).

The double cable portion arrangement described above allows the use of a smaller diameter cable; and the pulley 48 provides an equilibrium seeking feature that produces an equal force on the cable sections. The equilibrium seeking feature operates automatically without time-consuming adjustments. Alternatively, the counterbalancing assembly may include a single cable and a drum with one spiral groove.

A counterweight 49 lies suspended from the cable 46 between the pulley 48 and the drum 45. Another pulley 50 secured to the counterweight 49 allows the counterweight to ride on the cable 46 and provides a further self-adjusting feature for the assembly. The counterweight 49 applies a torque to the drum 45. This torque varies according to the location of the cable portions along the spiral grooves and applies a variable force to the curtain 21, a force which counters the variable gravitational forces acting on the curtain as it drops from an open to a closed position. Thus, the counterweight allows an operator to easily raise and lower the curtain 21.

The counterbalancing assembly 44 also includes a reducing weight 51 (See FIG. 5) which reduces the weight of the counterweight 49 to allow "drop testing" of the curtain 21 when it lies in a raised position. (When the curtain lies in an open position, wound around the drum 23, the counterweight 49 lies in its lower-most position.) An activating assembly 52 and a cable 53 suspend the weight 51 from the support plate P2. The activating assembly releases the weight 51 to begin the drop test.

During the drop test, the cable 53 connects or engages the weight 51 with the weight 49. This cable 53 extends through an opening in the weight 49 in sliding engagement with the weight 49 (from the bottom of the weight to the top), over a pulley 54, and to the weight 51. A stop 55 disposed at one end of the cable engages the bottom of the weight 49 (See FIG. 8). A spring 56 disposed at the opposite end of the cable 53 absorbs the shock when the stop 55 engages the weight 49.

Figures 5, 6:
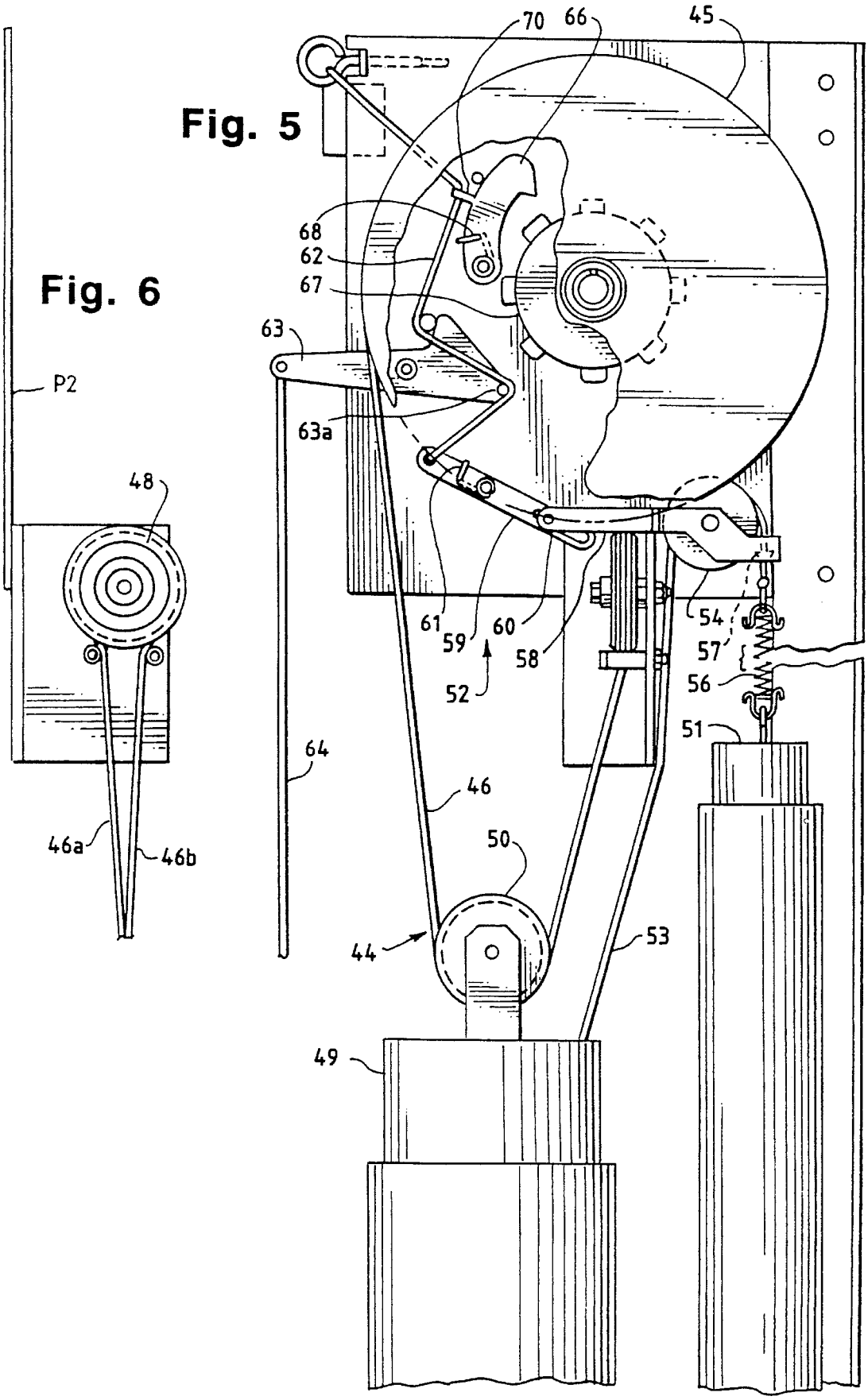
FIG. 5 is a side elevation view of the closure apparatus showing the side opposite the one shown in FIG. 3.
FIG. 6 is a front view of a cable connection used to secure a cable which supports the counterweight.

A second stop 57 secured to the cable 53 proximate the weight 51 allows a hook member 58 of the activating assembly 52 to hang the weight 51 from the plate P2 (as shown in FIG. 5). The weight 49 may then operate without interference from the weight 51 (See FIG. 8 which shows the relative positions of the weights when the curtain 21 lies closed and FIG. 9 which shows the relative position of the weights when the curtain 21 lies in a raised position).

In addition to the hook member 58 and the pulley 54, the activating assembly 52 includes a pivoting member 59 pivotally mounted to the support plate P2. It also includes the various cables, springs and cooperating components identified below. A sliding pivot connection at 60 connects one end of the member 59 to an end of the hook member 58. The member 58 also lies pivotally mounted, at the axle of the pulley 54, to the support plate P2. (The pivot connection which mounts the member 58 to the plate P2 also rotatably mounts the pulley 54 to the plate P2.) And, the opposite end of the hook member 58 has a yoke-like configuration to engage the bottom of the stop 57.

A cable 62 connects the end of the member 59 opposite the end with the sliding pivot to the link 40. This cable 62 allows an arm 63, which lies proximate the cable 62 and pivotally mounted to the plate P2, to move the members 58 and 59 to the position shown in FIG. 5. As an operator pulls, from below, a chain or cable 64 connected to the arm 63, the arm 63 moves counterclockwise, engaging the cable 62 with a knob 63*a*, removing the slack out of the cable 62, and moving the member 59 clockwise against the force of the spring 61. In response, the member 58 moves counterclockwise and engages the bottom of the stop 57. (The stop 57 moves to a position in which the member 58 engages it, when the weight 49 moves to its lowermost position, See FIGS. 9 and 11.)

An operator may release the weight 51 (to begin the drop test) by releasing the chain 64 and allowing the spring 61 to move the member 59 counterclockwise and the hook member 58 clockwise until the end of the hook member 58 pulls away from the stop 57. The weight 51 then drops downwardly until the stop 55 engages the bottom of the weight 49. Thus, the weight 49 reduces in magnitude by the magnitude of the weight 51 (See FIG. 10).

Counterclockwise movement of the link 40 (until a surface 40*a* engages a stop P3) also produces the requisite slack in the cable 62 to achieve the result described above. This movement, however, can only occur when a fusible link 65 breaks a cable connection 65*a* between the link 40 and a fixed support such as a wall. Such a movement also releases the drive at the chain hoist assembly 27 to assure closing of the curtain 21 during a fire when the fusible link breaks.

The activating assembly 52 also controls a pawl 66 which cooperates with a liquid governor 67 to control the descent of the curtain 21 (See FIGS. 12 and 13). A suitable pivot connection mounts the pawl 66 to the plate P2; and a spring 68 biases the pawl 66 against the governor where it engages the teeth 69 of the governor housing. The governor provides enough resistance to prevent the approximate equivalent of the removed weight from accelerating during the drop. The spring 68 moves the pawl 66 into position only when one of the procedures described above introduces slack into the cable 62 (which extends through a ring portion 70 of the pawl).

During normal operation, the chain hoist assembly 27 and the reducing weight activating assembly 52 remain engaged, holding the weight 51 in a static position. The operator may then raise and lower the curtain 21 using the chain hoist. To drop test the closure assembly when the curtain lies in a raised position, the operator disengages the chain hoist assembly by releasing the arm 41 and releases the weight 51 by disengaging the arm 63. During a fire, the fusible link 65 breaks and the link 40 pivots to provide slack in the cables 39 and 62. The chain hoist assembly then disengages and the activating assembly 52 releases the weight 51 to allow it to engage the weight 49.

The drum 45 described in the text above may be any conventional drum with one or more spiral grooves. However, the spiral groove should preferably have a configuration which compensates for the uneven or irregular wrap of the curtain of a rolling door. The drum of the present invention has such a configuration.

DeVito U.S. Pat. No. 3,981,343 teaches that the curvature of a spiral continuously decreases. However, without having an extremely large starting lever for the curtain of a rolling door, one cannot balance the door perfectly using this teaching.

Figure 7:
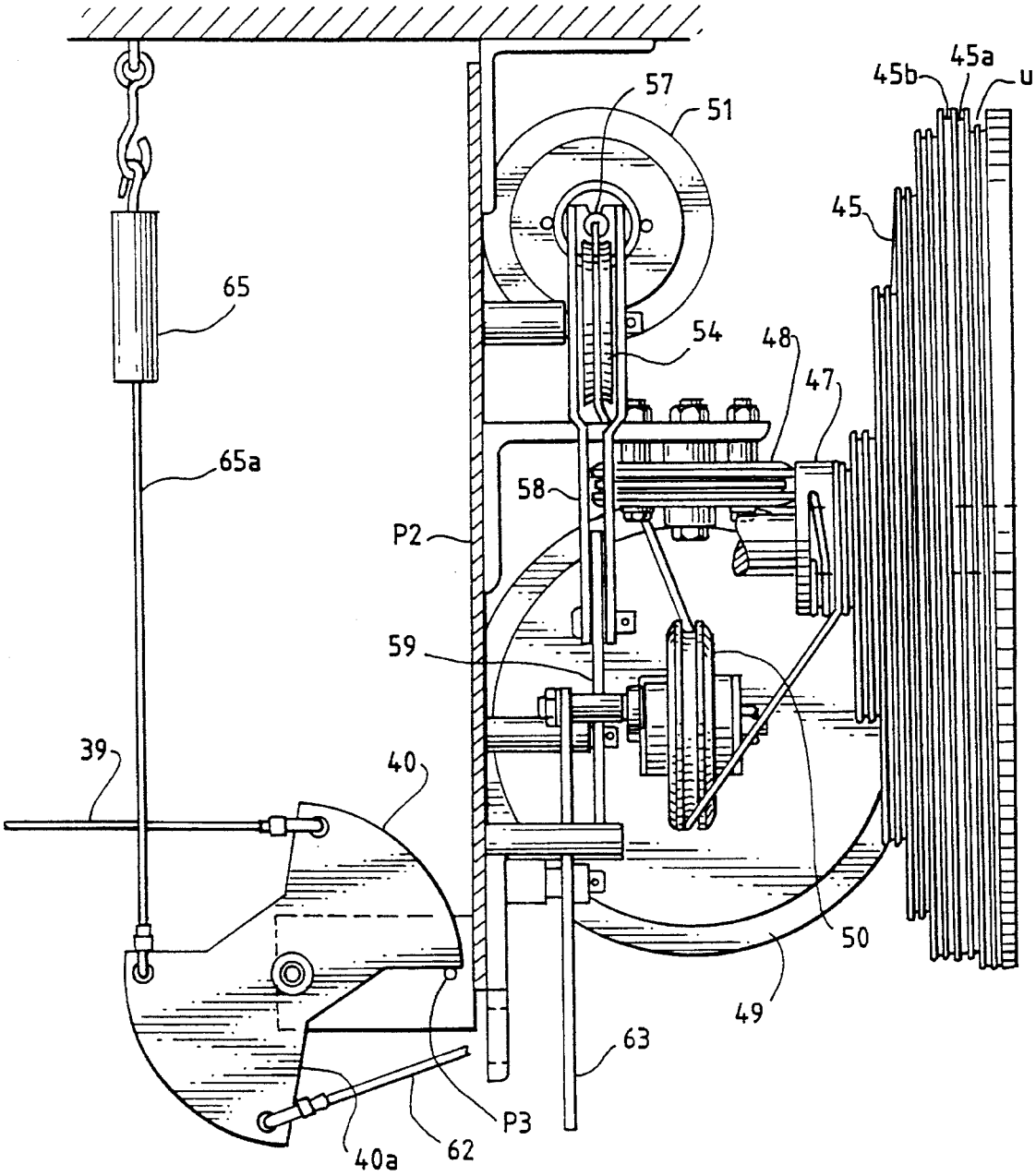
FIG. 7 is a top plan view of a portion of the closure apparatus located on the right side of FIG. 1.
Figure 16A:
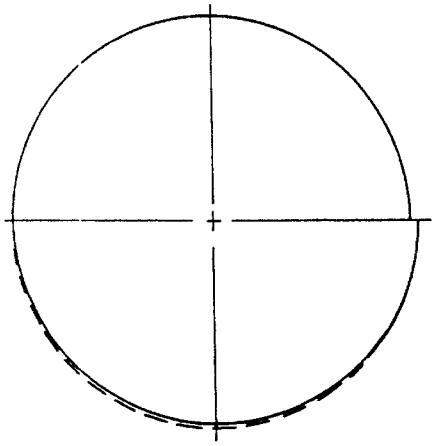
Figure 16B:
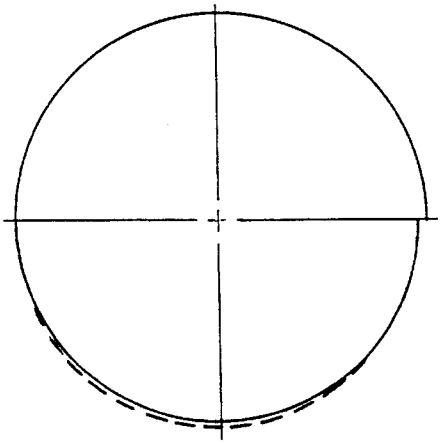
Figure 16C:
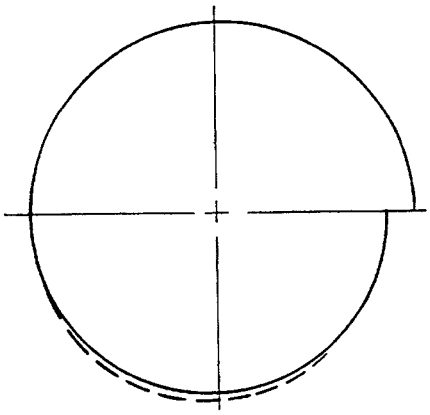
Figure 16D:
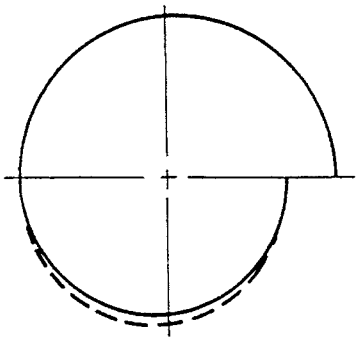
Figure 16E:
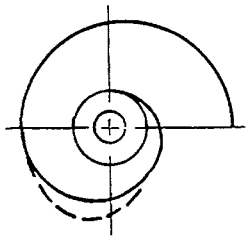

The spiral grooves of the drum 45 of the present invention has a unique "egg shaped" pattern as shown in FIGS. 16*a–e*. (These figures show the face of the drum 45. FIG. 7 shows a side elevation of the drum.) These FIGS. 16*a–e* show the DeVito pattern in solid lines and the pattern of the present invention in dotted lines where it differs from the DeVito spiral. (FIG. 16a shows the first full revolution; FIG. 16*b* shows the second; FIG. 16*c* the third; FIG. 16*d* the fourth; and FIG. 16*e* the fifth). Each door has its own unique "egg shaped" pattern, dictated by the shape of the slats, the starting lever arm of the curtain, and whether the curtain coils onto a round barrel only or onto a spiral shaped ring to create a smooth transition during the first revolution of wrap.

One may eliminate the egg shape of the spiral by increasing the starting lever arm of the curtain to eliminate the irregular wrap of the curtain. This is not a practical solution because the starting lever would be so large that most installations would not provide the requisite clearances above and outwardly of the wall opening. Also, such an alternative would markedly increase the cost of support plates, barrels, shafts, bearings and hoods. Those components would drastically increase in size for this alternative.

The spirals of the drum 45 of the present invention also include an "undercut" portion. This portion does not appear in every embodiment, however. It only appears if the percent of change in the curtain weight is less than the percent of change in the curtain lever arm as the curtain uncoils from a supporting drum member. FIG. 7 shows an undercut portion U in a drum 45 of the present invention.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings.

Figure 14:
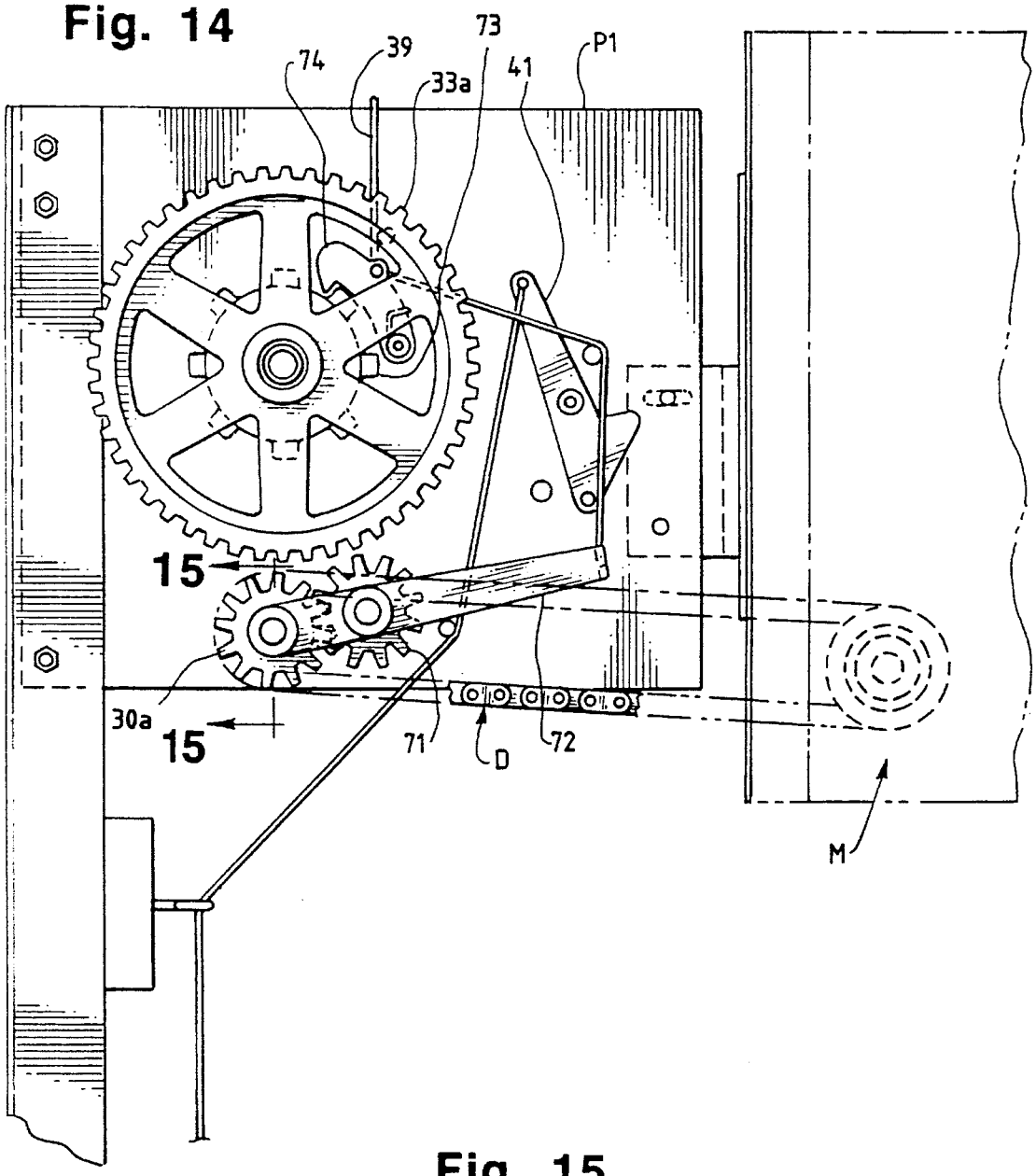
FIG. 14 is a side elevation view of an alternative drive assembly for raising and lowering the curtain.
Figure 15:
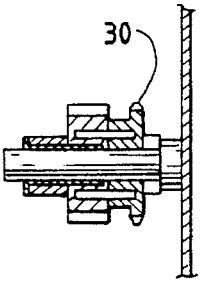
FIG. 15 is a sectional view taken along line 15—15 in FIG. 14.

For example, one may replace the chain hoist assembly 27 with a motor M and a drive D such as the one shown in FIGS. 14 and 15. This drive has a drop-away gear 71 for disengaging the drive during drop testing. During drop testing the arm 41 moves to the position shown in FIG. 14 and allows slack in the cable 39. In this embodiment, the cable 39 has a pivot arm 72 connected to it; and this pivot arm 72 drops and rotates clockwise when the arm 41 allows slack in the cable 39. The drop out gear 71 which lies rotatably mounted to the pivot arm 72 thus "drops out" from engagement with gear 33*a* and does not connect gears 30*a* and 33*a* any longer. This embodiment has the liquid governor 73 and a cooperating pawl 74 on the drive side of the apparatus. Reducing weight 51 is not required for this operation.

Other modifications include replacing the activating assembly with a solenoid arrangement or with any of a wide variety of electrical mechanical devices. A time delay assembly may replace or supplement the fusible link 65. This assembly would cooperate with alarms and smoke detectors to introduce slack in the system. In addition, one may add more drum and counterweight assemblies to the assembly depending on the size of the curtain 21. Finally, for small curtains, one may eliminate the chain hoist assembly and raise and lower the curtain 21 by hand.

Therefore, by the appended claims, the applicant intends to cover any modifications and other embodiments as incorporate those features which constitute the essential features of this invention.

What is claimed is:

1. A closure apparatus closing an opening in a partition including a frame disposed around the opening, said opening including a top end and a bottom end, said closure apparatus comprising: core means rotatably mounted to the partition at the top end of the opening for rotation about a predetermined axis; a curtain member secured to the core means, said curtain member wrapping around the core means to move out of the opening and extending from the core means to close the opening; counterweight means connected to the core means for countering the weight of the curtain member; reducing weight means connected to the frame for reducing the weight of the counterweight means; activating means for engaging the reducing weight means with the counterweight means to reduce the weight of the counterweight means and allow the curtain member to unwind from the core means and close the opening and for disengaging the reducing weight means from the counterweight means.

2. The closure apparatus of claim 1, wherein the core means includes an axle and governor means for reducing the speed of rotation of the axle as the axle rotates to allow the curtain member to unwind off of the drum member when the reducing weight means engages the counterweight means, said governor means cooperating with the axle and with a pawl member which is secured to the frame, said pawl member cooperating with the activating means.

3. The closure apparatus of claim 2, wherein cable means suspends the reducing weight means from the frame.

4. The closure apparatus of claim 3, wherein the cable means includes a first cable member secured at one end to the reducing weight means and extending through an opening in the counterweight means in sliding engagement with the counterweight means, said first cable member including a first stop at one end for engaging the counterweight means and a spring member at its other end for absorbing any shock generated when the stop engages the counterweight means.

5. The closure apparatus of claim 4, wherein the activating means includes latching means for cooperating with a second stop secured to the first cable member to suspend the reducing weight means from the frame, said latching means including a pivotable hook member for engaging the second stop, a second cable member connected at one end to the hook member, and slack controlling means disposed proximate the second cable member for controlling the slack in the second cable member and placing the hook member in an engaging position and in a release position.

6. The closure apparatus of claim 5, further comprising drive means connected to the core means for rotating the core means to unwind the curtain member on the core means.

7. The closure apparatus of claim 6, wherein the drive means includes a wheel rotatably mounted to the frame, a chain for rotating the wheel, a plurality of gears and a continuous chain for connecting the wheel with the axle, and engaging means for engaging and disengaging the drive means.

8. The closure apparatus of claim 7, wherein the activating means includes linkage means for connecting the second cable member with the engaging means, said linkage means including a release member which allows the engaging means to disengage the drive means and the slack controlling means to move the hook member in a release position.

9. The closure apparatus of claim 1, wherein the core means includes an axle and a drum member disposed around the axle.

10. The closure apparatus of claim 6, wherein the drive means includes a motor, a plurality of gears, a sprocket and continuous chain assembly for connecting the motor with the plurality of gears and engaging means for engaging and disengaging the drive means.

11. A closure apparatus for closing an opening in a partition including a frame disposed around the opening, said opening including a top end and a bottom end, said apparatus comprising: a drum member rotatably mounted to the partition at the top end of the opening; a curtain member secured to the drum member, said curtain member wrapping around the drum member to move out of the opening and extending from the drum to close the opening; counterweight means connected to the drum member for countering the weight of the curtain member; reducing weight means connected to the frame for reducing the weight of the counterweight means; drive means connected to the drum member for rotating the drum member to wind the curtain member on the drum member; activating means for engaging the reducing weight means with the counterweight means to reduce the weight of the counterweight means and allow the curtain member to unwind from the drum member and close the opening, for releasing the drive means to allow free rotation of the drum member, and for disengaging the reducing weight means from the counterweight means; said drum member including an axle and governor means for reducing the speed of rotation of the axle as the axle rotates to allow the curtain member to unwind off of the drum member when the reducing weight means engages the counterweight means, said governor means cooperating with the axle and a pawl member which lies pivotally mounted to the frame and which cooperates with the activating means.

12. The closure apparatus of claim 11, wherein cable means suspends the reducing weight means from the frame.

13. The closure apparatus of claim 12, wherein the cable means includes a first cable member secured at one end to the reducing weight means and extending through an opening in the counterweight means in sliding engagement with the counterweight means, said first cable member including a stop at one end for engaging the counterweight means and a spring member at its other end for absorbing any shock generated when the stop engages the counterweight means.

14. The closure apparatus of claim 13, wherein the activating means includes latching means for cooperating with a second stop secured to the first cable member to suspend the reducing weight means from the frame, said latching means including a pivotable hook member for engaging the second stop, a second cable member connected at one end to the hook member, and slack controlling means disposed proximate the second cable member for controlling the slack in the second cable member and placing the hook member in an engaging position and in a release position.

15. The closure apparatus of claim 14, wherein the drive means includes a wheel rotatably mounted to the frame, a chain for rotating the wheel, a plurality of gears and a continuous chain for connecting the wheel with the axle, and engaging means for engaging and disengaging the drive means.

16. The closure apparatus of claim 15, wherein the activating means includes linkage means for connecting the second cable member with the engaging means, said linkage means allowing the engaging means to disengage the drive means and the slack controlling means to move the hook member in a release position.

17. The closure apparatus of claim 16 wherein the linkage means includes a pivotable release member and a link with a fusible member.

* * * * *